US006293577B1

(12) United States Patent
Shields

(10) Patent No.: US 6,293,577 B1
(45) Date of Patent: Sep. 25, 2001

(54) FOOT BINDING ASSEMBLY

(76) Inventor: Peter Shields, P.O. Box 91, Mammoth Lakes, CA (US) 93546

( * ) Notice: Subject to any disclaimer, the term of this patent is extended or adjusted under 35 U.S.C. 154(b) by 25 days.

(21) Appl. No.: 08/726,056

(22) Filed: Oct. 3, 1996

(51) Int. Cl.[7] ..... A63C 9/00

(52) U.S. Cl. ..... 280/617; 280/620; 280/14.22

(58) Field of Search ..... 280/607, 617, 280/618, 14.2, 623, 625, 626, 631, 619, 620, 14.22; 36/114, 115, 117.1

(56) References Cited

U.S. PATENT DOCUMENTS

| | | | |
|---|---|---|---|
| D. 308,997 | 7/1990 | Katz | D21/230 |
| 4,058,326 | 11/1977 | Faulin | 280/617 |
| 4,624,646 | 11/1986 | Strohmeier | 441/76 |
| 4,973,073 | 11/1990 | Raines et al. | 280/624 |
| 4,979,760 | 12/1990 | Derrah | 280/607 |
| 5,035,443 | 7/1991 | Kincheloe | 280/618 |
| 5,143,396 | 9/1992 | Shaanan et al. | 280/607 |
| 5,145,202 | 9/1992 | Miller | 280/613 |
| 5,172,924 | 12/1992 | Barci | 280/14.2 |
| 5,188,386 | 2/1993 | Schweizer | 280/607 |
| 5,190,311 | 3/1993 | Carpenter et al. | 280/618 |
| 5,236,216 | 8/1993 | Ratzek | 280/607 |
| 5,261,689 | 11/1993 | Carpenter et al. | 280/618 |
| 5,299,823 | 4/1994 | Glaser | 280/625 |
| 5,338,051 | 8/1994 | Szafranski et al. | 280/607 |
| 5,354,088 | 10/1994 | Vetter et al. | 280/618 |
| 5,356,159 | 10/1994 | Butterfield | 280/14.2 |
| 5,362,087 | 11/1994 | Agid | 280/611 |
| 5,401,041 | 3/1995 | Jespersen | 280/14.2 |
| 5,409,244 | 4/1995 | Young | 280/14.2 |
| 5,417,443 | 5/1995 | Blattner et al. | 280/14.2 |
| 5,556,123 | 9/1996 | Fournier | 280/607 |
| 5,727,797 * | 3/1998 | Bowles | 280/14.2 |
| 5,758,895 * | 6/1998 | Bumgarner | 280/607 |

FOREIGN PATENT DOCUMENTS

| | | |
|---|---|---|
| 91 13 766 | 4/1992 | (DE) . |
| 4416023 * | 10/1995 | (DE) . |
| 44 16 023 | 10/1995 | (DE) . |
| 195 04 026 C1 | 8/1996 | (DE) . |
| 671190 * | 3/1995 | (EP) . |
| WO 95 19205 | 7/1995 | (WO) . |

* cited by examiner

*Primary Examiner*—Michael Mar
(74) *Attorney, Agent, or Firm*—Lyon & Lyon LLP

(57) ABSTRACT

A foot binding assembly particularly adapted for use as a snowboard binding and including a base portion which is adapted to be secured to the snowboard, a heel support portion adapted to be carried by the base portion and an ankle/toe securement assembly which is pivotally mounted with respect to the base portion and movable between an open and closed position. In the open position a boot can be readily inserted into and removed from the binding and in the closed position the securement assembly bears against portions of a boot inserted into the binding and cooperates with the base and heel support portions to encase the boot within the binding. A releasable locking mechanism is employed for maintaining the securement assembly in the closed position upon the assembly being pivoted to the closed position, thereby securing and supporting the boot within the binding.

26 Claims, 5 Drawing Sheets

FIG. 3
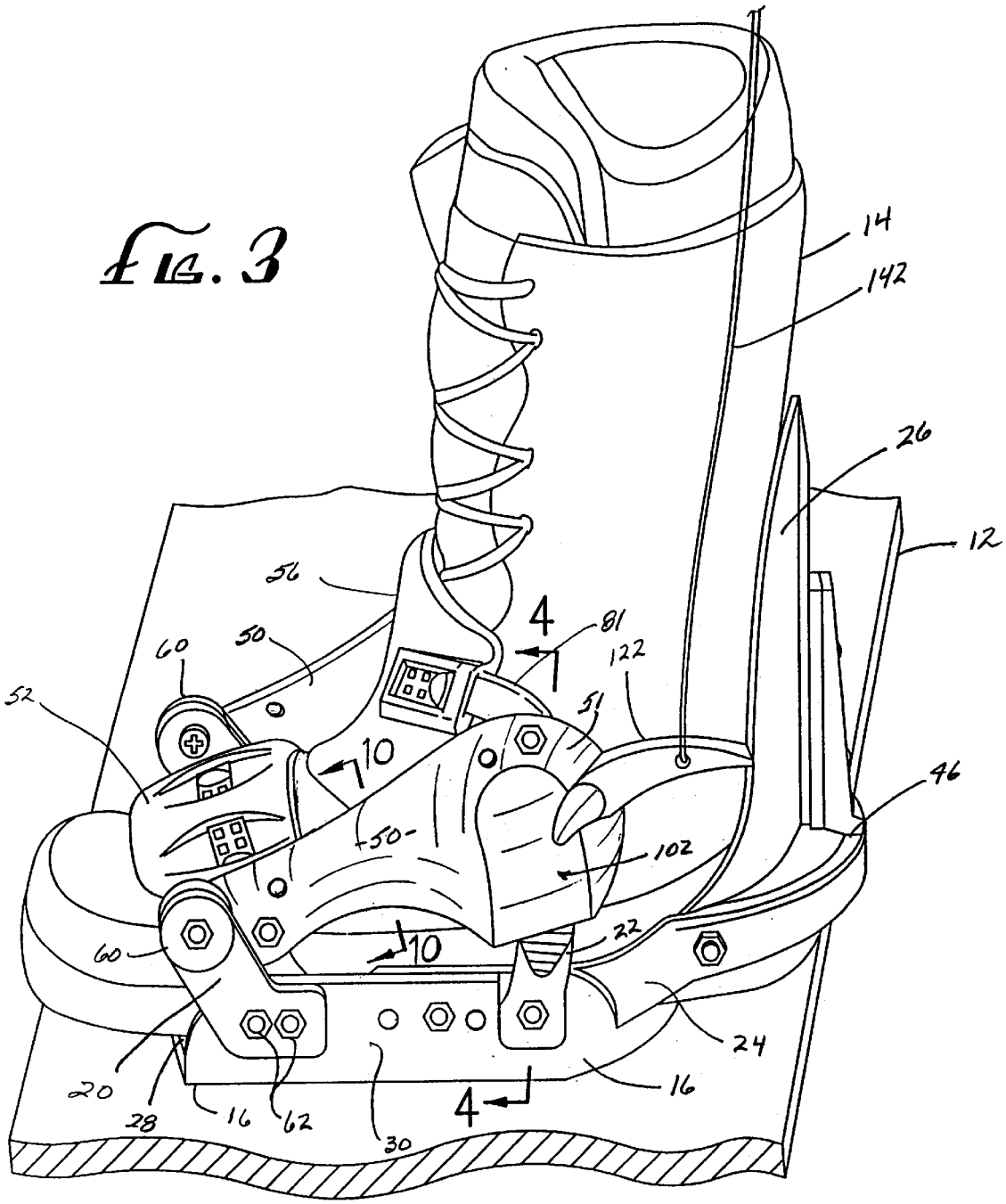
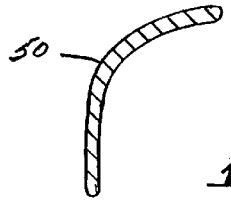
FIG. 10.

FOOT BINDING ASSEMBLY

BACKGROUND OF THE INVENTION

The present invention relates to a foot binding assembly which is particularly adapted for use as a snowboard binding. The sport of snowboarding is rapidly growing in popularity and the number of new participants may one day exceed that of snow skiing. The present invention relates to the bindings which secure the snowboarder to his or her board. Unlike snow skiing, snowboard bindings are not designed to release when a predetermined pressure is exerted on the binding during a fall. It has been found to be far safer for a snowboarder to have both feet tightly secured to the snowboard during a fall due to the large surface area of a snowboard and the high risk of suffering an ankle or leg injury in the event only one of the bindings was to release. Nevertheless, the binding is an extremely important piece of equipment to the snowboarder. It must provide a solid securement of the boot to the board which will not release unintentionally even during a severe fall. Snowboard bindings should also provide firm and consistent support for the rider's feet and ankles which often assume rather severe and varying inclinations relative to their bodies in negotiating turns and other maneuvers. The need for support is particularly acute for the high percentage of snowboarders who prefer to snowboard in soft boots which provide little of the support for the foot and ankle areas necessary to negotiate many of the typical maneuvers which the sport allows.

In addition to providing solid securement and firm and uniform support, snowboard bindings should be capable of being easily secured to the boot and readily released. The combination of all these qualities is perhaps peculiar to snowboarding as the snowboard rider must repeatedly remove and resecure at least one of their boots to the board after each run. At the bottom of the run, a snowboarder typically detaches their rear foot from their board so they can propel themselves (or "skate") to the chair lift. While riding on the chair lift, the rear foot and boot remain disengaged from the board. When descending from the chair, the rider places his or her free foot on the top of the board and slides onto an area where the rear binding can be resecured for the ride down the hill. Resecurement of these bindings frequently requires the user to sit on the cold snow while affixing their free boot to the board. Conventional bindings also require repeated tightening and readjusting of the straps, thus causing inconvenience and discomfort.

Not only are conventional strap-type snowboard bindings awkward and difficult to secure, they can present a significant safety hazard when a snowboarder falls in deep snow. With only one foot securely affixed to the board it is not that difficult to extricate oneself from such a position. However, with both feet rigidly secured to the board and one's arms and torso buried in the snow without ready access to the straps to release at least one of the bindings, a very real risk of hypothermia and/or suffocation is created. Indeed, several snowboarders have perished each year as a result of such situations.

Thus, it is very important that a snowboard binding not only provide adequate support for the rider's feet and ankles and a solid securement of the boot to the board capable of withstanding severe falls without releasing, but also that the securement be obtained with minimal effort by the snowboarder and that the binding be readily and quickly releasable. It is also desirable that the binding be usable with the soft comfortable boots used by most snowboarders. Previous attempts to provide improved snowboard bindings have generally focused on less than the totality of these features. For example, step-in-type bindings have been developed to facilitate the securement and release of the boots to and from the snowboard. Such bindings, however, typically require an attachment to be permanently affixed to the bottom, back or sides of the boot which matches and interfaces with an attachment on the snowboard such that when the snowboarder places his or her foot onto the board in proper alignment and steps down, the boot and board are locked together. Unfortunately, such bindings generally require the purchase of new boots which are particularly designed to interface with the bindings. In addition, these boots can only be used for snowboarding and typically only on the board which contains a matching attachment. In addition, such bindings provide little support, thus requiring a use of a more rigid boot. As a result, the comfort of the soft boot preferred by many snowboarders is lost.

Unlike the bindings heretofore available, the snowboard binding of the present invention not only provides the tight securement and support necessary for snowboard riding while executing the various maneuvers snowboarding allows, it is also usable with conventional soft boots and is readily secured to and released from the rider's boots. As a result, the present invention enhances both the safety and enjoyment of snowboarding.

SUMMARY OF THE INVENTION

The binding of the present invention as adapted for use as a snowboard binding employs a self-locking ankle/toe securement assembly which is pivotally mounted on a base portion and cooperates with the base portion and a rear heel/achilles support to provide a consistent and evenly distributed tight securement and strong support for the rider's foot and ankle. The cooperation of the ankle/toe securement assembly with the base portion of the binding and the locking mechanism employed allow the binding both to be easily secured in place about the rider's boot and readily releasable to remove the boot.

More particularly, the binding comprises the base portion which is supported on and secured to the snowboard, the ankle/toe securement assembly which is pivotally mounted on opposed sides of the base portion proximate the forward end thereof, and the rear heel/achilles support which is adjustably mounted on the base portion proximate the rear end thereof. A pair of readily releasable ratchet-type locking mechanisms are carried by opposed sides of the ankle/toe securement assembly which cooperate with aligned ratcheting elements carried by opposed sides of the base portion of the binding. To secure and lock the binding about the boot, the rider need only place his or her foot within the open binding and push the ankle/toe securement assembly downwardly against the boot to the desired tightness. As the securement assembly is pushed against the boot, the boot is properly aligned on the binding. The engaged locking mechanisms will then hold the ankle/toe securement assembly in place about and against the boot, securing the boot within the binding without the need for further adjustment. Each of the locking mechanisms preferably includes an extended release trigger for quickly opening the locking mechanism to release the boot from the binding and additionally providing the rider with a lever arm to facilitate the pivoting of the ankle/toe securement assembly into locking engagement with the base portion.

The ankle/toe securement assembly which releasably locks the boot in place includes a pair of laterally opposed support arms pivotally mounted on opposite sides of the base portion of the binding, an adjustable toe cover pivotally mounted on and extending across the support arms proximate the forward ends of said arms, and an adjustable ankle cover pivotally mounted on and extending across the support arms proximate the rearward ends of said arms. The toe and ankle covers are each preferably contoured to mate with and press tightly, yet comfortably, against the upper and lateral toe and ankle portions of the boot upon the ankle/toe securement assembly being pivoted into the closed or locked position. The base portion of the binding abuts and provides support for the lower lateral portions of the boot. Together, the base portion, heel/achilles support and ankle/toe securement assembly encase and provide a tight and comfortable securement and solid support for the rider's foot and ankle, while the pivotal mounting of the ankle/toe securement assembly and quick release ratchet locks allow the binding to be easily closed and secured about the boot and quickly opened to release the boot.

The ankle/toe securement assembly and/or the heel/achilles support are each adjustable to accommodate boots of different sizes. The heel/achilles support is adjustable longitudinally to accommodate boots of different lengths, while the toe and ankle covers on the securement assembly are adjustable along their transverse dimensions to accommodate boots of varying girth. The pivotal mounting of the toe cover enables the toe cover to be pressed snugly against the upper surface of the toe portion of the boot in the locked position and not dig into the boot as the ankle/toe securement assembly is pivoted forwardly to release the boot. The pivot mounting of the toe cover also cooperates with the pivotal mounting of the ankle/toe securement assembly to move the toe cover to an elevated forward position upon the securement assembly being pivoted to the fully open position. As a result, boot removal and reentry is substantially facilitated.

The ankle cover is preferably formed so as to define an inner pad surface which is concave in a transverse direction across the ankle and convex in a longitudinal direction. As a result, the cover better conforms with the contour of the boot and the rider's ankle thereby maximizing the surface area of contact between the cover and boot which provides both improved securement and comfort for the rider.

The ratchet-type locking mechanism by which the ankle/toe securement assembly is readily secured and released preferably employs a pair of arcuate upstanding locking arms mounted on opposed sides of the base portion of the binding, each arm being provided with a plurality of transversely extending and longitudinally spaced ratchet teeth. One or more oppositely facing ratchet teeth are provided on a pair of pivotally mounted ratchet members carried by the opposed support arms of the ankle/toe securement assembly within housings having open lower ends aligned with and adapted to receive one of the upstanding locking arms. The ratchet members are each spring biased within their respective housings and arcuately aligned with one of the upstanding locking arms on the base portion of the binding such that upon pivoting the securement assembly downwardly toward the rider's boot, the locking arms are received in the housings adjacent the ratchet member therein. As the ankle/toe securement assembly continues to pivot toward the boot, the ratchet members are continuously urged against the locking arms, causing the opposed ratchet teeth on the locking arms and locking members to cooperate and allow unidirectional pivotal movement of the securement assembly toward the closed position against the boot and retain the ankle/toe securement assembly against the boot. To tighten the binding about the boot it is only necessary to press the ankle/toe securement assembly more tightly against the boot whereupon the locking mechanism will ratchet one or more teeth and again hold the assembly in place against the boot.

A release trigger defining a cam member proximate its inner end is pivotally mounted on each support arm of the ankle/toe securement assembly such that an upward or lifting pressure exerted on the trigger will cause the cam member to move between the locking arm and ratchet member, separating the ratchet teeth thereon and releasing the engagement of the ankle/toe securement assembly with the boot. A downward pressure exerted on the release triggers will press the ankle/toe assembly against the boot to tighten the binding. As a result of this configuration, both tight securement and instantaneous release of the boot can be effected by simply pressing against or pulling upwardly on the two trigger arms of the securement assembly.

Thus, it is the object of the present invention to provide a binding for a snowboard which tightly and uniformly secures and supports the rider's foot and ankle areas on the board, is readily secured in place about the rider's boot and is easily and quickly opened to remove the boot.

It is another object of the present invention to provide a snowboard binding which is compatible with soft boots and provides firm and uniform support for the rider's foot and ankle.

It is a further object of the present invention to provide a binding which both aligns the boot on the binding during securement and eliminates the need to repeatedly readjust the binding during use.

It is yet another object of the present invention to provide a binding for snowboards which requires no modification of or additions to the boot for use with the binding.

It is a further object of the present invention to provide a binding for a snowboard which is self-locking to a desired tightness about the rider's boot by simply pressing portions of the binding against the boot.

It is a still further object of the present invention to provide a binding for a snowboard which is opened to release the rider's boot by simply pulling on portions of the binding.

It is still another object of the present invention to provide a snowboard which can be opened to release the rider's boot by simply pulling upwardly on a single cord secured to the binding release mechanism.

It is yet another object of the present invention to provide a structural frame which is easily secured about the wearer's foot, provides even and consistent support wherever desired for wearer's foot and ankle areas for different footwear applications and is easily and quickly opened to release the foot.

These and other objects and advantages of the present invention will become readily apparent from the following detailed description taken in conjunction with the accompanying drawings.

BRIEF DESCRIPTION OF THE DRAWINGS

FIG. 3 is a perspective view of the binding of the present invention shown in the secured position about a snowboard boot.

FIG. 10 is a cross-sectional view taken along the line 10—10 in FIG. 3.

DETAILED DESCRIPTION OF THE PREFERRED EMBODIMENTS

Figure 1:
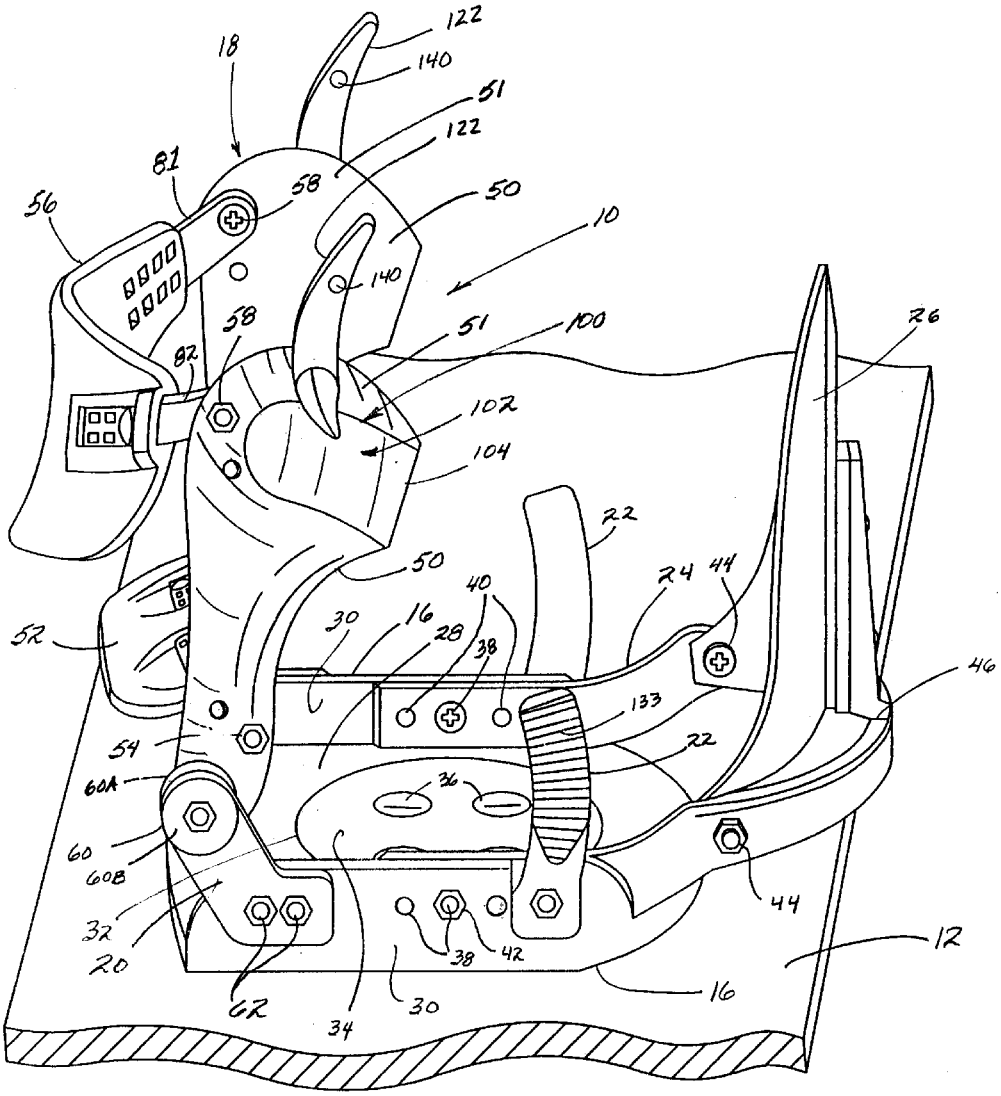
FIG. 1 is a perspective view of a binding of the present invention illustrating the ankle/toe securement position in the open or release position.
Figure 2:
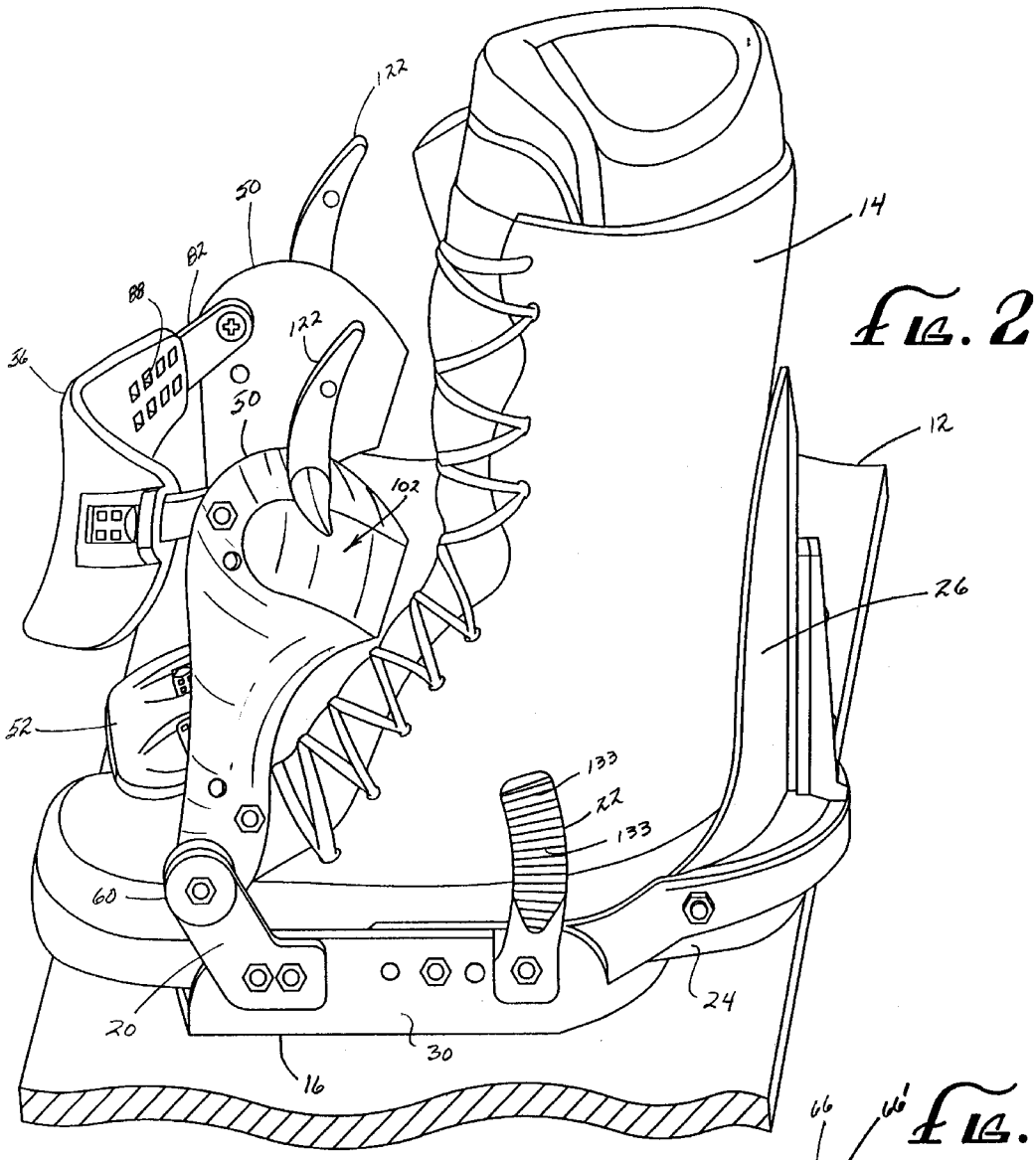
FIG. 2 is a perspective view of the binding of the present invention illustrating the ankle/toe securement assembly in the open or release position with a snowboard boot in the binding.

Referring now in detail to the drawings, FIG. 1 shows the binding 10 of the present invention mounted on a snowboard 12 in the open position adapted to receive therein a snowboarding boot 14 as seen in FIG. 2. Binding 10 includes a base portion 16 and an ankle/toe securement assembly 18 which is pivotally mounted on a pair of laterally disposed extension arms 20 carried by the base portion 16 proximate the forward end thereof. A pair of laterally disposed upstanding arcuate locking arms 22 are carried by base portion 16 proximate the rear end thereof for securement of the free ends of the ankle/toe securement assembly 18 to the base portion 16 of the binding as will be described. Binding 10 also includes an adjustable heel slide 24 and an adjustable achilles plate 26.

The base portion 16, heel slide 24 and achilles plate 26 can each be of a conventional configuration. As seen for example in FIG. 1, base portion 16 comprises bottom wall 28 and a pair of opposed upstanding lateral walls 30. Bottom wall 28 defines an enlarged centrally disposed aperture 32 therein which is bordered by an inclined and serrated wall (not shown) and is adapted to receive a mounting disk 34. Mounting disk 34 also defines an inclined and serrated perimeter wall (not shown) for mating engagement with the perimeter wall of aperture 34 and anchors the binding 10 to the snowboard 12 in the desired angular orientation with threaded fasteners 36. It is to be understood that other configurations of base portion 16 could be employed in the binding of the present invention.

The heel slide 24 is generally of a U-shaped configuration and is affixed to the lateral walls 30 of base portion 16 by fastening members 38. Additional apertures 40 are preferably provided in the heel slide 24 for selective alignment with one of the opposed apertures 42 in the walls 30 of the base portion to provide longitudinal adjustment of the heel slide 24 on base portion 16 to accommodate boots of varying length. The achilles plate 26 is pivotally secured to the U-shaped heel slide 24 by pivot mounts 44. A vertically adjustable stop 46 is provided on the back side of the achilles plate 26 which abuts the upper surface of the rear of the heel slide 24 and thus limits the pivotal movement of plate 26 in a rearward or clockwise direction as seen in FIG. 1. Adjusting the elevation of stop 46 on plate 26 thus varies the degree of forward inclination of achilles plate 26. As with the configuration of base portion 16, other configurations of heel/achilles supports could be employed in the binding of the present invention.

The ankle/toe securement assembly 18 comprises a pair of opposed support arms 50, a toe cover 52 pivotally mounted on and spanning support arms 50 proximate the forward ends by means of opposed pivot mount 54, and an ankle cover 56 mounted on and spanning support arms 50 proximate the rear ends thereof at 58. The ankle cover 56 is preferably pivotally mounted on support arms 50 at 58 to better accommodate differing boot configurations. Support arms 50 are pivotally mounted adjacent their forward ends on extensions 20 by means of pivot mounts 60. Extensions 20 project upwardly at a forward inclination from the forward end 16' of base portion 16. As seen in FIGS. 1–9, extension arms 20 are secured to lateral walls 30 of the base portion of the bindings by a pair of fastening members 62. Alternatively, extension arms 20 could be integrally formed with the base portion of the binding.

To facilitate entry into the binding 10 and securement of the ankle/toe securement assembly 18 against the boot 14 it is preferable to limit the extent to which the securement assembly 18 can be opened relative to the base portion 16 of the binding. Pivoting the securement assembly 18 counterclockwise beyond about an 11:00 position, as viewed in FIG. 1, would be counter productive to boot entry and the securement of assembly 18 about the boot. Accordingly, the pivot mounts 60 by which the securement assembly is mounted are preferably provided with pivot limit stops. To provide such a stop, pivot mounts 60 are each comprised of mating pivot members 60A and 60B wherein pivot members 60A are secured to the forward end portions of the support arms 50 and pivot members 60B are secured to the upper ends of lateral extensions 20. Pivot members 60B each define an arcuate channel therein (not shown) into which an axially projecting pin (not shown) extends which is carried by a pivot member 60A. Thus, the extent of the relative pivotal movement of pivot member 60A to member 60B is limited by the arcuate length of the channel in pivot member 60B, which in turn correspondingly limits the pivotal movement of the ankle/toe securement assembly 18 relative to the base portion 16 of the binding. Other means for limiting the movement of securement assembly 18 could, of course, be employed.

The toe cover 52 which spans the forward end portion of support arms 50 is configured so as to press tightly against the upper toe portion of the snowboarding boot 14 upon the ankle/toe securement assembly being pivoted to the closed position illustrated in FIG. 3. In so doing, cover 42 should preferably conform to the configuration of the upper surface of toe portion of the boot to provide maximum securement and comfort. Accordingly the toe cover 52 should be constructed of a flexible material. It is also preferable that the toe cover 52 be adjustable along its length to allow for variations in the girth of the boot 14.

To allow the ankle/toe securement assembly to press tightly against the toe and ankle portions of boot 14 in the closed position illustrated in FIG. 3 and be pivoted to the open position of FIG. 2 with a boot in place, it is necessary to provide a movable mounting for the toe cover relative to the lateral support arms 50 on which the toe cover is mounted. Without such a mounting, the cover would tend to dig into the toe portion of the boot and would prevent the assembly from being pivoted to the open position. To obtain this result, the toe cover 52 is pivotally mounted at its extended lateral ends on support arms 50. This allows the cover to be drawn snugly against the upper toe portion of the boot in the closed position and to then pivot on the lateral support arms 50 of the securement assembly 18 as the assembly is pivoted about its pivot mounts 60 to the opened position and the toe cover 52 is pressed against the boot. Upon reaching the open position illustrated in FIG. 2, the toe cover 52 is moved to an elevated forward position facilitating both the removal and entry of the boot.

Figure 9:
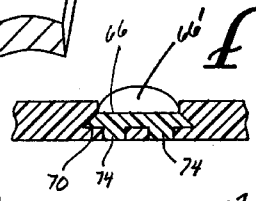
FIG. 9 is a sectional view taken along the line 9—9 of FIG. 8.
Figure 8:
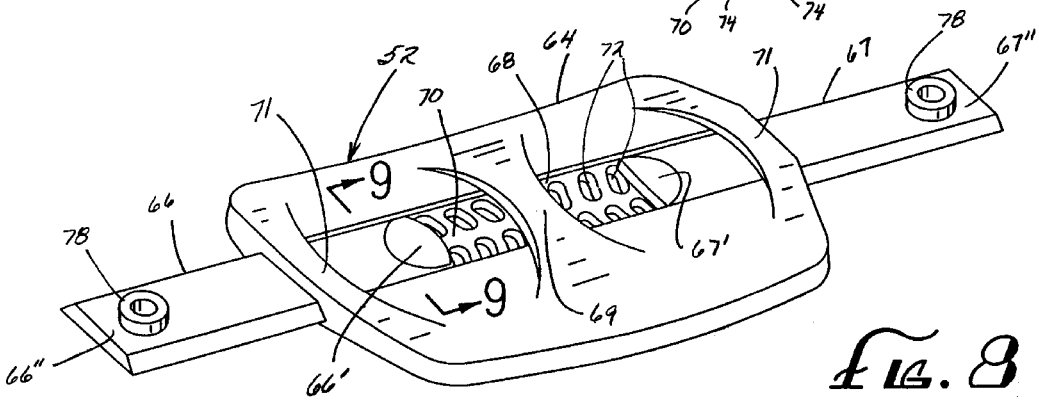
FIG. 8 is a perspective view of a toe cover employed in the ankle/toe securement assembly of the present invention.

A preferred embodiment of toe cover 52 is illustrated in FIGS. 8 and 9. As seen therein, toe cover 52 comprises a pad portion 64 and a pair of strap members 66 and 67. The pad and strap members are preferably constructed of flexible and durable rubber-like materials, such as a thermoplastic rubber or urethane. Pad 64 defines a channel 68 extending transversely through an upper portion thereof in which strap members 66 and 67 are slidably mounted and from which they extend from the pad. Pad 64 also defines a central web portion 69 to identify the center of the pad to facilitate uniform adjustment of strap members 66 and 67 and to provide additional structural support for the pad. Outer web portions 71 are also provided on the pad which project over strap members 66 and 67 and help retain the strap members within channel 68. The bottom wall 70 of channel 68 defines a plurality of spaced pairs of apertures 72 therein adapted to receive two correspondingly configured pairs of protuberances 74 integrally formed with and projecting from the undersides of strap members 66 and 67. By altering the pairs of apertures 72 in which the protuberances 74 are secured, the lateral extension of the strap members from the pad can be varied to provide adjustability in the effective transverse dimension of the toe cover 52 so as to better accommodate boots of varying girth.

To facilitate the adjustment of strap members 66 and 67, the inner ends 66' and 67' thereof are preferably molded in an arcuate configuration, allowing the rider to insert the end of one of his or her fingers under the ends of the strap members and thus more easily pull the strap members from their engagement with the pad. The raised ends 66' and 67' also cooperate with the outer webs 71 defined by the pad 64 to inhibit separation of the strap members from the pad portion of the cover. The strap members 66 and 67 are also preferably molded with raised eyelets 78 formed in the extended end portions 66" and 67" thereof to facilitate the pivotal mounting of the toe cover 52 on support arms 50 by means of pivot mounts 54.

Figure 7:
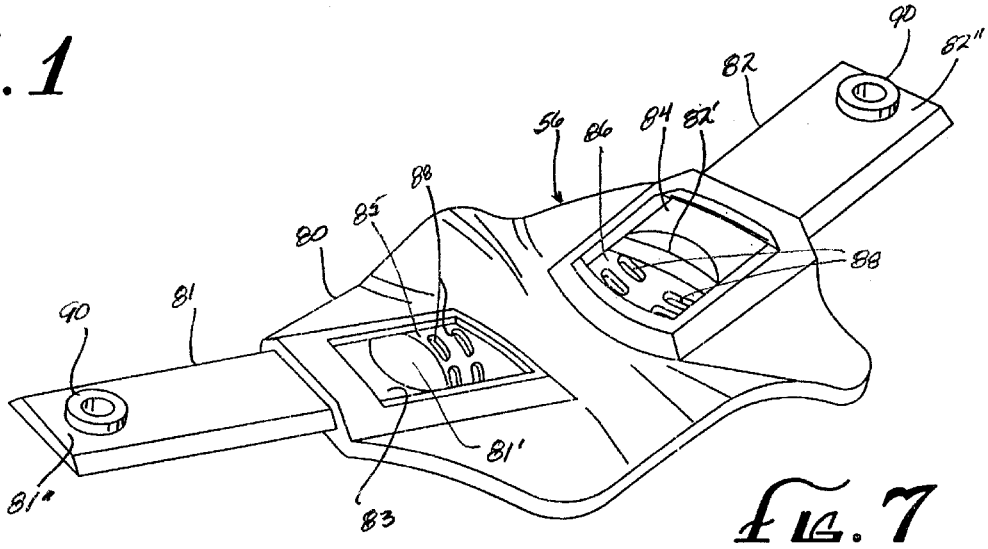
FIG. 7 is a perspective view of the ankle cover employed in the ankle/toe securement assembly of the present invention.

The preferred configuration of the ankle cover 56 is illustrated in FIG. 7. Ankle cover 56 comprises a pad portion 80 and strap members 81 and 82 which are preferably constructed of materials similar to those of toe cover 54. Pad 80 defines a pair of spaced-apart transversely extending channels 83 and 84 therein which are open at their extended lateral ends and contain the inner portions of strap members 81 and 82. The bottom walls 85 and 86 of channels 83 and 84 each define a plurality of pairs of spaced apertures 88 therein adapted to receive one or more pairs of correspondingly configured protuberances (not shown) formed on the underside of strap members 81 and 83 so as to provide the same securement and adjustability feature in the ankle cover 56 described above with respect to the toe cover 52.

As with the strap members on the toe cover, the inner ends 81' and 82' of strap members 81 and 82 are also preferably formed in an arcuate configuration to facilitate strap adjustment and the extended ends 81" and 82" thereof are preferably formed with eyelets 90 therein for the pivotal mounting of the ankle cover 56 on support arms 50 with pivot mounts 58. The pad portion 80 of ankle cover 56 is also preferably molded so as to better conform with the contour of the boot 14 and with the rider's ankle. By molding the pad 80 out of a flexible material such as a thermoplastic rubber such that the interior surface of the pad is concave in the transverse direction across the ankle and convex in the longitudinal direction along the ankle, the area of surface contact between the pad portion 80 of the ankle cover 52 and the rider's boot is maximized for increased support and comfort.

In lieu of the embodiments of the toe and ankle covers discussed above and illustrated in the drawings, strap members formed of conventional nylon webbing (not shown) could be employed with the flexible pad portions of the covers. The inner ends of the strap members could be sewn, woven through or otherwise suitably attached to the pad portions and the extended ends of the strap members adjustably secured in buckles pivotally mounted on the support arms 50 of the binding at locations corresponding to mounts 54 and 58. Raised eyelets similar in configuration to eyelets 58 and 90 on the extended ends of the strap members in the toe and ankle covers 52 and 56 could also be formed in the support arms 50 to assist in providing the pivotal mounting of the buckles on the support arms. In such configurations of the toe and ankle covers, the adjustability in transverse length would be provided by the buckles carried by the ankle/toe securement assembly 18 as opposed to the variable engagements of the inner end portions of the strap members with apertures in the flexible pads.

In addition to the construction of the toe and ankle covers discussed above, the base portion 16, heel slide 24, achilles plate 26 and support arms 50 of binding 10 are preferably constructed of a hard and durable materials. The various pivot mounts used in the binding can be of any suitable configuration including threaded fastening members and lock nuts.

The locking mechanisms 100 preferably employed in the present invention to provide the releasable securement of the rear boot receiving ends 51 of the ankle/toe assembly support arms 50, are of the ratchet type, and are carried within housings 102 formed in the rear ends 51 of arms 50 and cooperate with the arcuately configured upstanding locking arms 22 on base portion 16 of the binding 10 to effect the desired securement and adjustment.

Figures 4, 5, 6:
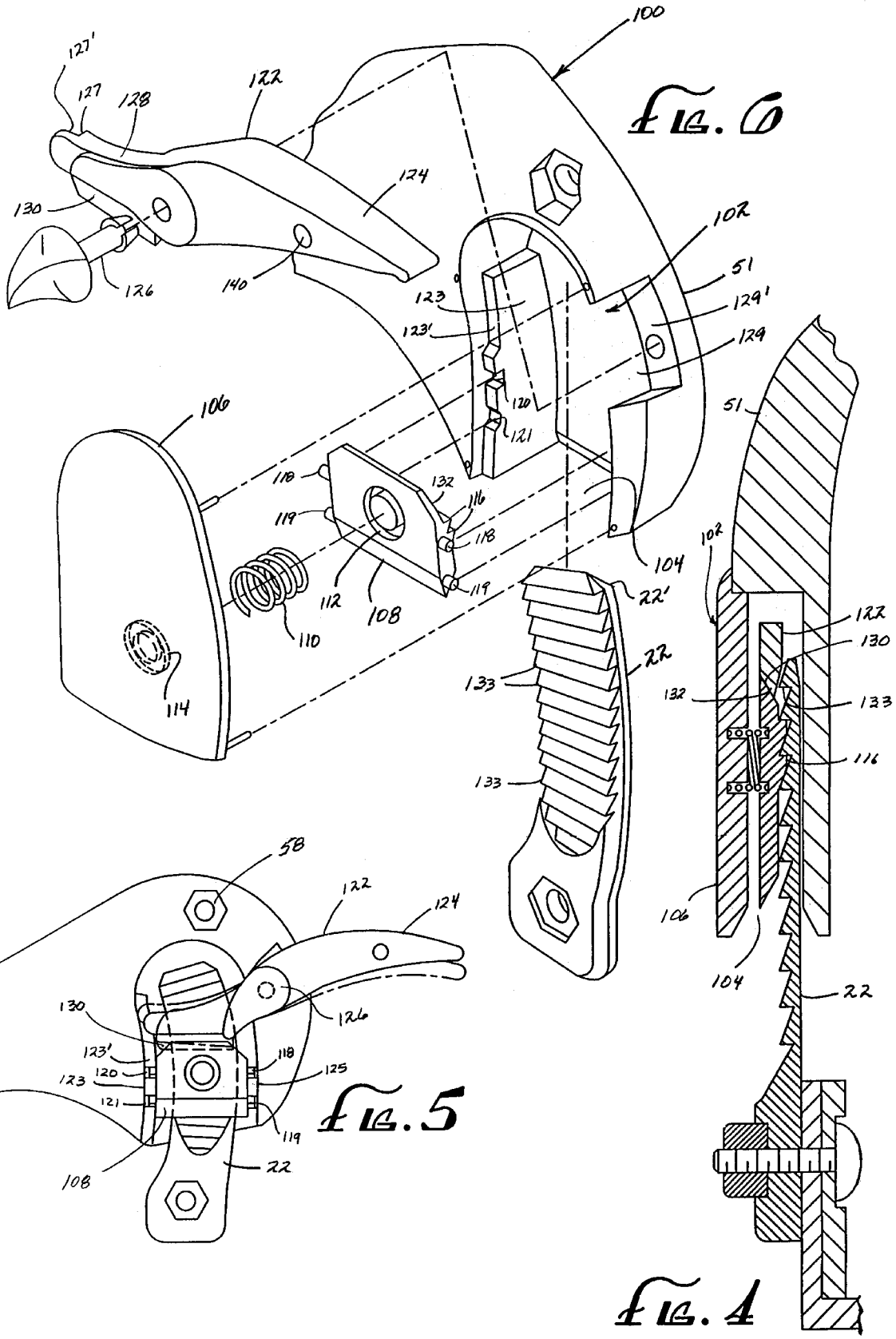
FIG. 4 is a sectional view taken along the line 4—4 in FIG. 3.
FIG. 5 is a partial side view of one of the ratchet locking mechanisms of the present invention illustrating the camming action of the mechanism.
FIG. 6 is an exploded perspective view of one of the ratchet locking mechanisms of the present invention.

The configuration and operation of locking mechanisms 100 are best illustrated in FIGS. 4–6. As seen therein, each mechanism is disposed within a covered housing 102 preferably formed in raised portions of the rear ends 51 of the support arms 50. Alternatively, exterior housings could be secured onto the outer surfaces of rear ends 51. Housings 102 are each provided with an open lower end 104 adapted to receive one of the upstanding arcuate locking arms 22, are closed by a cover 106 and contain a ratchet member 108 therein which is biased inwardly within the housing by means of a coil spring 110. The ratchet members 108 each define an annular recess 112 in the outwardly facing surface thereof adapted to receive the inner end portion of coil spring 110. A similarly configured recess 114 is provided in the interior surface of the housing cover 106 whereby the outer end portions of the springs 110 are retained as illustrated in FIG. 4. A pair of ratchet teeth 116 are defined by the inwardly facing surface of each ratchet member 108. A pair of vertically spaced cylindrical posts 118 and 119 project laterally from each side of ratchet members 108 and are held within vertically spaced slots 120 and 121 formed in the outwardly facing ends of laterally opposed sidewalls 123 and 125 disposed within housing 102 and by the housing cover 106. As will be explained, the lower posts 119 on the ratchet member define pivot pins, while the upper posts 118 function as stops to limit the movement of ratchet members 108 within the housing 104.

A release trigger 122 defining an extended lever arm 124 at the rearward end thereof is pivotally mounted by means of a pin 126 in the rear end 51 of each of the locking arms such that the forward end portions 128 of trigger arms 122 project into the housings 102 through slots 129 formed in the back side thereof as best seen in FIG. 6. The forward end portions 128 of the trigger arms 122 define inclined camming surfaces 130 at the lower ends thereof adapted to abut a correspondingly tapered interior surface 132 on the ratcheting elements 108 above the ratchet teeth 116 thereon.

To secure the binding 10 about a boot 14, the ankle/toe securement assembly 18 is pivoted to the open position illustrated in FIG. 1. The rider can then easily step into the binding such that the boot is disposed therein as shown in FIG. 2. The rider then simply pushes the ankle/toe assembly 18 downwardly toward the boot. Because of the arcuate alignment of the longitudinal axes of the locking mechanism housings 102 with the locking arms 22, the resulting pivotal movement of the securement assembly 18 about pivot mounts 60 will bring the upper end portions 22' of the locking arms into the housings 102 through the open lower ends 104 thereof adjacent the ratchet member 108 pivotally mounted therein. Concurrently, the toe cover 52 abuts the upper toe surface of boot 14 and, as the ankle/toe securement assembly continues downwardly, the toe cover is caused to pivot about mounts 54 on the support arms 50 so as to remain flush with the toe portion of the boot as the assembly 18 is pressed against the boot to the desired tightness. At the same time the ratchet teeth 133 on the locking arm will ratchet past the oppositely facing ratchet teeth 116 on the spring biased ratchet element 108. As the ratchet member 108 is urged by spring member 110 against locking arm 22, when the desired tightness of the ankle and toe assembly against the rider's boot is obtained, the engaging teeth will securely retain the ankle and toe securement assembly in that position about and against the foot and ankle portion of the boot. In pressing the ankle/toe assembly 18 downwardly against the boot, the projecting lever arm portions 124 of triggers 122 effectively extend the moment arms for pivoting the assembly against the boot and thereby further reduce the effort required to secure the binding in place.

To release the engagement of the ankle/toe assembly 18 from the locking arms 22 carried by the base portion 16 of the binding, it is only necessary to pull upwardly on the lever arm portions 124 of the release triggers 122. Such motion causes the triggers to pivot about pins 126 whereupon the camming surfaces 130 on the interior portions of the triggers press downwardly against the inclined surfaces 132 on the ratchet members 108, causing the members to pivot about the lower posts 119 thereon and separate the ratchet teeth 116 on ratchet members 108 from the ratchet teeth 133 on the upstanding locking arms 22. Thus, in a single lifting movement of the two triggers, the binding 10 is released. The movement of the relative components to release the bindings is perhaps best seen in FIGS. 4 and 5.

Upon the removal of the locking arms 22 from housings 102, the retention of upper posts 118 on the sides of the ratchet members 108 in slots 121 by housing covers 106 will limit the inward movement of the upper portion of the ratchet elements within their housings 102 and thereby prevent the spring members 110 from being able to force the upper portions of the ratchet members to an inoperative position behind the camming surfaces 130 on triggers 122.

To maintain the proper alignment of the triggers 122 within housings 102, a notch 127 is provided in the backside of the extended end of each trigger. The spring member 110 presses the camming surface 132 on the ratchet member 108 inwardly against the camming surface 130 on the trigger. The pressure of the spring member causes the end wall 127' of notch 127 to be pressed against a portion of the outwardly facing end 123' of the interior housing sidewall 123. Thus, as the release triggers pivot about pins 126 during use, they are continuously maintained in proper alignment by the spaced contact of the triggers with the housing walls 129' through which the trigger pivot pins 126 extend and with the ends 123' of sidewalls 123.

An aperture 140 is also preferably provided in the lever arm portions 124 of the triggers so that a safety line 142 can be secured to the lever arms of each trigger as seen in FIG. 3 to facilitate release of the binding 10 in the event of a fall the result of which leaves the rider without ready access to the release triggers. Preferably one such line 142 would be used with each binding and would fork proximate its lower end so that the one line could be secured to both of the triggers on the binding.

While the embodiments of the invention illustrated in the drawings employ ratchet-type locking mechanisms to automatically lock the ankle/toe securement assembly in place about and against the user's boot, other types of securement mechanisms could be used. The ratchet-type is preferred, however, as it not only provides the self-locking feature but also gives the user a tooth-by-tooth microadjustment of the tightness of the binding about the boot. Nevertheless, other mechanisms such as buckles, cords and straps fitted with hook and loop type fasteners (Velcro) could be employed to releasably secure the rear end portions of the lateral support arms on the ankle/toe securement assembly to the base of the binding and still retain many of the advantages of the present invention.

Figure 11:
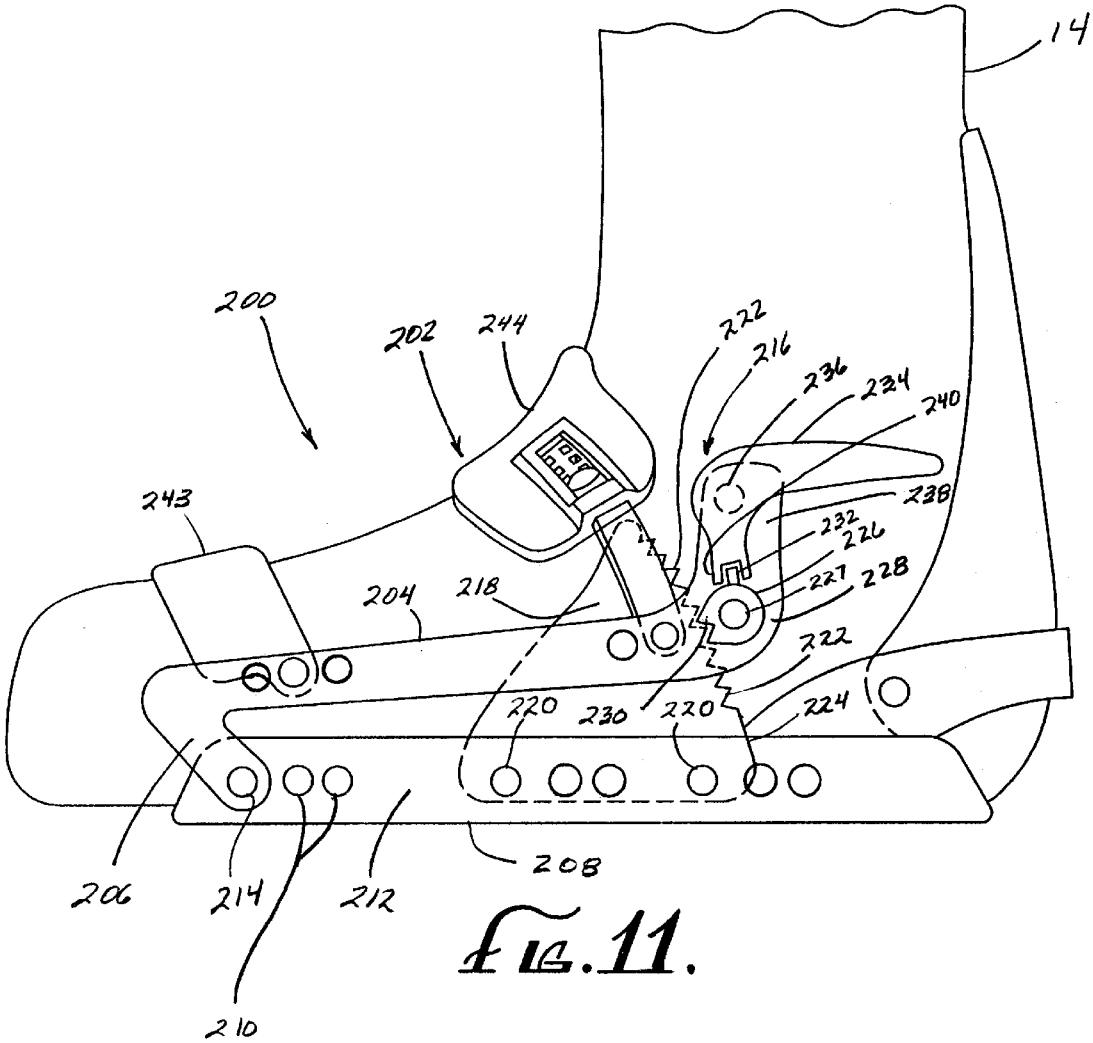
FIG. 11 is a side view illustrating an alternate embodiment of the binding of the present invention.

An alternate embodiment of the snowboard binding is illustrated in FIG. 11. The binding 200 shown therein differs from the prior embodiment in two primary respects. In the ankle/toe assembly 202 of binding 200, the lateral support arms 204 define the forwardly and upwardly inclined extensions 206 as integral parts thereof. The support arms 204 are pivotally mounted to the base portion 208 of binding 200 by pivot mounts 214 extending through aligned apertures provided in the lower end portions of the extensions 206 of support arms 204 and in the opposed side walls 212 of base portion 208. Additional apertures 210 are provided in the base walls 212 to vary the location of the pivot mounts 214 whereby the location of the pivotal mounting of ankle/toe assembly 202 on base portion 208 can be adjusted to accommodate boots of varying length.

Binding 200 also includes an alternate embodiment of the locking mechanism for securing the ankle/toe securement assembly 202 in place against boot 14. The locking mechanism 216 of binding 200 includes a pair of ratchet members 218 (only one being shown) mounted on the opposite side walls 212 of the base portion 208 of binding 200. The ratchet members are adjustably secured in place on walls 212 by means of threaded fastening members 220. Additional mounting apertures 221 are provides in the base walls 212 whereby the positioning of ratchet members 218 on the base portion of the binding can be adjusted to accommodate any adjustments in the mounting of the support arms 204 on base portion 212.

Each of the ratchet elements 218 defines a plurality of ratchet teeth 222 in a forwardly inclined rear edge surface 224. A pair of pivotally mounted ratchet members 226 are carried by the rearward portions 228 of support arms 204 and each defines a pair of teeth 230 adapted to engage the teeth 222 on one of the ratchet members 218. The pivotally mounted ratchet members 226 also define a projection 232 extending radially therefrom. A coil or leaf spring (not shown) is provided in each of the ratchet members 226 which cooperates with the pivot mount 227 on which the ratchet member 226 is mounted to continuously bias the ratchet members 226 into the position shown in FIG. 11 wherein the teeth 230 defined thereon are in engagement with the ratchet teeth 222 on one of the fixed ratchet elements 218. A release trigger 234 is pivotally mounted at 236 on a rearwardly disposed vertically extending portion 238 of each of the support arms 204. The release triggers 234 each define a rearwardly extending lever arm 240 and a vertically extending inverted "U"-shaped channel 242 in which the radial projection 232 of one of the ratchet elements 226 is disposed.

The operation of binding 200 and the locking mechanisms 216 thereon is similar to the binding and locking mechanisms of the prior embodiment. Upon urging the ankle/toe securement assembly 202 toward the closed position about boot 14, the teeth on ratchet members 218 and 226 will engage and the pivotal mounting of ratchet members 226 will allow for a ratcheting effect as element 226 moves along ratchet element 218. When the desired tightness is attained, the engaging teeth on the two locking mechanisms of each binding will hold the free ends of the ankle/toe securement assembly 202 firmly in place against the boot. By raising the lever arm portions 240 of the release triggers 234, the ratchet elements 226 are caused to pivot by the cooperation of the radial projections 232 thereon with the gripping channels 242 of the triggers 234. Pivotal movement of the ratchet elements 226 will disengage the teeth 230 thereon from the ratchet teeth 222 on the fixed ratchet elements 218, releasing the binding 200 such that the ankle/toe securement assembly 202 can merely be raised to the fully open position for removal of the boot 14. The construction and operation of the toe and ankle covers 243 and 244 on binding 200 could be of the same construction and operate in the same manner as toe and ankle covers 52 and 56 of the prior embodiment.

In addition to use as a snowboard binding, the present invention could be employed as a binding in other applications such as snowshoes and wake boards wherein an automatic release is not needed. It could also be employed in a variety of footwear applications wherein the mechanism does not actually function as a typical binding, but as the frame of the footwear itself, as for example, in a sandle or athletic shoe. In a shoe application the mechanism would secure and provide strong uniform support for the wearer's foot and ankle within the shoe and additionally provide for easy entrance and removal. Thus, the device would, in effect, bind the foot and ankle to the sole and outer fabric of the shoe as opposed to a rigid snowboard or ski.

Various other changes and modifications may be made in carrying out the present invention without departing from the spirit and scope thereof. Insofar as those changes and modifications are within the purview of the appended claims, they are to be considered as part of the present invention.

I claim:

1. A binding for securing a boot to a snowboard, said binding comprising:

a base portion adapted to be secured to the snowboard;

a heel support portion carried by said base portion;

an ankle and toe securement assembly pivotally mounted with respect to said base portion and movable between an open position wherein a boot can be readily inserted into and removed from said binding and a closed position wherein said assembly bears against portions of a boot inserted into said binding and cooperates with said base and heel support portions to encase the boot within the binding, said closed position including a plurality of selected pivotal positions of said securement assembly relative to said base portion, said securement assembly including at least one flexible strap element secured thereto; and a pair of locking assemblies, each of said locking assemblies comprising a first portion and a second portion, said first portions being carried by laterally opposed portions of said securement assembly and said second portions being carried by laterally opposed portions of said base portion, said first and second portions of each of said locking assemblies cooperating to maintain said securement assembly in said closed position upon said securement assembly being pivoted to said closed position, thereby securing and supporting the boot within the binding, and a release mechanism operable to interrupt the cooperation of said first and second portions such that said securement assembly can be pivoted to said open position.

2. The binding of claim 1 wherein said ankle and toe securement assembly comprises a pair of laterally spaced support arms pivotally mounted on opposed sides of said base portion of said binding, a toe cover carried by and spanning said support arms and an ankle cover carried by and spanning said support arms, said toe cover being movably mounted on said support arms whereby said toe cover can press against a toe portion of a boot in said closed position and move relative to said support arms as said assembly is pivoted about a boot to said open position.

3. The binding of claim 2 wherein said second portions of said locking assemblies include a pair of laterally spaced extension arms mounted on and projecting upwardly from opposed sides of said base portion, said support arms of said securement assembly being pivotally mounted on said extension arms.

4. The binding of claim 2 wherein said release, mechanism includes a pair of members pivotally mounted on said support arms and each of said members comprises a lever arm portion proximate one end thereof and a camming surface proximate a second end thereof, said camming surface abutting one of said portions of one of said locking assemblies such that upon said lever arm portion being moved in an upward direction, said camming surface moves said one portion of said locking assembly out of engagement with the second portion thereof, whereby said securement assembly can be moved to the open position.

5. The binding of claim 1 wherein said ankle and toe securement assembly comprises a pair of laterally spaced support arms defining forward end portions and rearward end portions, said arms being pivotally mounted at said forward end portions thereof on opposed sides of said base portion of said binding, a toe cover pivotally mounted on and spanning said support arms proximate said forward end portions thereof, and an ankle cover mounted on and spanning said support arms proximate said rearward end portions thereof.

6. A binding for securing a boot to a snowboard, said binding comprising:

a base portion adapted to be secured to the snowboard;

a heel support carried by said base portion;

an ankle and toe securement assembly comprising a pair of laterally spaced support arms pivotally mounted on opposed sides of said base portion of said binding, a toe cover pivotally mounted on and spanning said support arm and an ankle cover carried by and spanning said support arms, said securement assembly being movable with respect to said base portion between an open position wherein a boot can be readily inserted into and removed from said binding and a closed position wherein said assembly bears against portions of a boot inserted into said binding and cooperates with said base and heel portions to encase the boot within the binding, said closed position including a plurality of selected pivotal positions of said securement assembly relative to said base portion; and a pair of locking assemblies, each of said locking assemblies comprising a a first portion and a second portion, said first portions being carried by laterally opposed portion of said securement assembly and said second portions being carried by laterally opposed portions of said base portion, said first and second portions of each of said locking assemblies cooperating to maintain said securement assembly in said closed position upon said securement assembly being pivoted to said closed position, thereby securing and supporting the boot within the binding, and a release mechanism operable to interrupt the cooperation of said first and second portions such that said securement assembly can be pivoted to said open position.

7. The binding of claim 6 including a pair of laterally spaced extension arms mounted on and projecting upwardly from opposed sides of said base portion, said forward end portions of said securement assembly support arms being pivotally mounted on said extension arms.

8. A binding for securing a boot to a snowboard, said binding comprising:

a base portion adapted to be secured to the snowboard;

a heel support carried by said base portion;

ankle and toe securement assembly comprising a pair of laterally spaced support arms pivotally mounted an opposed sides of said base portion of said binding, a toe cover pivotally mounted on and spanning said support arms and an ankle cover carried by and spanning said support arms, said securement assembly being movable with respect to said base portion between an open position wherein a boot can be readily inserted into and removed from said binding and a closed position wherein said assembly bears against portions of a boot inserted into said binding and cooperates with said base and heel portions to encase the boot within the binding, said closed position including a plurality of selected pivotal positions of said securement assembly relative to said base portion; and a releasable locking mechanism including a pair of locking assemblies, each of said locking assemblies comprising a first portion and a second portion, said first portions being carried by laterally opposed portions of said securement assembly and said second portions being carried by laterally opposed portions of said base portion, said first and second portions of each of said locking assemblies cooperating to maintain said securement assembly in said closed position upon said securement assembly being pivoted to said closed position and a release member operable to interrupt the cooperation of said first and second portions such that said securement assembly can be pivoted to said open position.

9. The binding of claim 8 including a pair of laterally spaced extension arms mounted on and projecting upwardly from opposed sides of said base portion, said forward end portions of said securement assembly support arms being pivotally mounted on said extension arms.

10. A binding for securing a boot to a snowboard, said binding comprising:

a base portion adapted to be secured to the snowboard and defining upstanding lateral wall portions;

a heel support carried by said base portion;

an ankle and toe securement assembly comprising a pair of lateral support arms, a toe cover and an ankle cover, said support arms defining forward and portions and rearward end portions, said arms being pivotally mounted at said forward end portions thereof on said lateral side walls of said base portion, said toe cover being pivotally mounted on and spanning said support arms proximate said forward end portions thereof and said ankle cover being mounted on and spanning said support arms proximate said rearward end portions thereof, whereby said securement is movable between an open position wherein a boot can be readily inserted into and removed from said binding and a closed position wherein said assembly bears against portions of a boot inserted into said binding and cooperates with said base and heel support portions to encase the boot within the binding;

a releasable locking mechanism for maintaining said securement assembly in said closed position, said mechanism comprising a pair of upstanding arcuate locking arms, one of said arms being carried by each of said lateral side walls of said base portion, and a pair of locking members, one of said members being carried by each of said rearward end portions of said support arms, said locking members being in arcuate alignment with said locking arms whereby as said securement assembly is pivotally moved to said closed position, said locking members engage said locking arms and retain said securement assembly in said closed position, said closed position including a plurality of selected pivotal positions of said securement assembly relative to said base portion; and a pair of release members, one of said release members being pivotally mounted on each of said rearward end portions of said support arms and operable to release the engagement of a locking member with a locking arm whereby said securement assembly can be pivoted from said closed position to said open position.

11. The binding of claim 10 including a pair of laterally spaced extension arms mounted on and projecting upwardly from opposed sides of said base portion, said forward end portions of said securement assembly support arms being pivotally mounted on said extension arms.

12. The binding of claim 10 wherein said locking arms each define a first plurality of ratchet teeth thereon and said locking assemblies additionally each comprise an open ended housing adapted to receive one of said upstanding locking arms upon said securement assembly being pivoted toward said closed position, a ratchet member disposed within said housing and defining a second plurality of ratchet teeth thereon, said teeth on said ratchet members engaging said teeth on said locking arms upon said locking arms being received within said housing so as to allow unidirectional pivotal movement of said securement assembly toward said closed position and to retain said support arms in place relative to said base portion to maintain said securement assembly in said closed position.

13. The binding of claim 12 wherein said release members are pivotally mounted proximate each of said housings and a portion of each of said members projects into one of said housings, said projecting portion defining a camming surface thereon, said camming surface mating with a portion of one of said ratchet member such that pivotal movement of said release member causes said camming surface to move downwardly against said portion of said ratchet member and urge said teeth on said ratchet member out of engagement with said teeth on said locking arm.

14. The binding of claim 13 including a release cord having a first end portion and a bifurcated second end portion, said second end portion being secured to said release members such that upon said cord pulled by said first end portion, said release members are caused to pivot on said support arms and separate said locking members from said locking arms thereby releasing said engagement.

15. The binding of claim 13 including a spring member disposed in each of said housings, said spring member biasing said ratchet member therein against said upstanding locking arm upon said locking arm being disposed within said housing for maintaining said ratchet teeth on said ratchet member in ratcheting engagement with said ratchet teeth on said upstanding arm portion.

16. A binding for securing a boot to a snowboard, said binding comprising:

a base portion adapted to be secured to the snowboard;

a heel support carried by said base portion;

an ankle and toe securement assembly comprising a pair of laterally spaced support arms pivotally mounted on opposed sides of said base portion of said binding, a toe cover pivotally mounted on and spanning said support arms and an ankle cover carried by and spanning said support arms, said securement assembly being movable with respect to said base portion between an open position wherein a boot can be readily inserted into and removed from said binding and a closed position wherein said assembly bears against portions of a boot inserted into said binding and cooperates with said base and heel portions to encase the boot within the binding, said closed position including a plurality of selected pivotal positions of said securement assembly relative to said base portion;

a releasable locking mechanism for maintaining said securement assembly in said closed position, said mechanism comprising a first pair of ratchet members carried by opposed portions of said base portion of said binding and defining thereon a first plurality of ratchet teeth, and a second pair of ratchet members carried by said laterally spaced support arms and defining thereon a second plurality of ratchet teeth, said second ratchet members being in arcuate alignment with said first ratchet members whereby as said securement assembly is moved to said closed position, said teeth on said second plurality of ratchet members engage said teeth on said first plurality of ratchet members so as to allow unidirectional pivotal movement of said securement assembly toward said closed position and to retain and support arms in place relative to said base portion to maintain said securement assembly in said closed position; and a pair of release members, one of said release members being pivotally mounted on each of said lateral support arms and operable to separate said first plurality of ratchet teeth from said second plurality of ratchet teeth whereby said securement assembly can be pivoted from said closed position to said open position.

17. The binding of claim 16 including a pair of laterally spaced extension arms mounted on and projecting upwardly from opposed sides of said base portion, said support arms of said securement assembly being pivotally mounted on said extension arms.

18. The binding of claim 16 wherein said support arms on said securement assembly define downwardly projecting forward end portions, said end portions being pivotally mounted on said opposed sides of said base portion.

19. The binding of claim 16 including a release cord having a first end portion and a bifurcated second end portion, said second end portion being secured to said release members such that upon said cord being pulled by said first end portion, said release members are caused to pivot on said support arms and disengage said first plurality of ratchet teeth from said second plurality of ratchet teeth.

20. The binding of claim 16 wherein said toe cover comprises a pad portion and a pair of strap members slidably mounted on said pad portion and projecting from opposed lateral sides thereof, said strap members being engagable with said pad portion at a plurality of laterally spaced positions on said pad portion whereby said toe cover is adjustable along its transverse dimension, and wherein said strap members are pivotally mounted on said laterally spaced support arms of said securement assembly.

21. The binding of claim 16 wherein said ankle cover comprises a pad portion and a pair of strap members slidably mounted on said pad portion and projecting from opposed lateral sides thereof, said strap members being engagable with said pad portion at a plurality of laterally spaced positions on said pad portion whereby said toe cover is adjustable along its transverse dimension, and wherein said pad portion defines an inner surface, said surface being concave in a first transverse direction and convex in a second direction normal to said first direction.

22. A footwear frame for securing an item of footwear about a wearer's foot and ankle, said frame comprising:

a base portion;

a heel support portion carried by said base portion;

an ankle and toe securement assembly pivotally mounted with respect to said base portion and movable between an open position wherein a wearer's foot can be readily inserted into and removed from said frame and a closed position wherein said assembly bears against portions of a foot and ankle inserted into said frame and with said base and heel support portions encasing the foot within the frame, said closed position including a plurality of selected pivotal positions of said securement assembly relative to said base portion; and a pair of locking assemblies, each of said locking assemblies comprising a first portion and a second portion, said first portions being carried by laterally opposed portions of said securement assembly and said second portions being carried by laterally opposed portions of said base portion, said first and second portions of each of said locking assemblies cooperating to maintain said securement assembly in said closed position upon said securement assembly being pivoted to said closed position, thereby securing and supporting the boot within the binding, and a release member operable to interrupt the cooperation of said first and second portions such that said securement assembly can be pivoted to said open position.

23. The footwear frame of claim 22 wherein said ankle and toe securement assembly comprises a pair of laterally spaced support arms pivotally mounted on opposed sides of said base portion of said frame, a toe cover pivotally mounted on and spanning said support arms and an ankle cover carried by and spanning said support arms.

24. The footwear frame of claim 23 including a pair of laterally spaced extension arms mounted on and projecting upwardly from opposed sides of said base portion, said support arms of said securement assembly being pivotally mounted on said extension arms.

25. The footwear frame of claim 23 wherein each of said locking assemblies comprises a first portion and a second portion, said first portions being carried by said support arms of said securement assembly, said second portions being carried by laterally opposed portions of said base portion of said frame in arcuate alignment with said first portions whereby as said securement assembly is pivotally moved from said open position to said closed position, said first portions of said locking assemblies engage said second portions thereof and retain said securement assembly in said closed position.

26. A snowboard binding having:

a binding plate adapted for attachment to a snowboard, to receive a shoe or boot of a user;

a back support secured to the binding plate at a rear portion thereof; and means for attaching the shoe or boot to the binding plate, including at least one flexible strap element adapted to fit over the shoe or boot of the user, wherein said shoe or boot attaching means comprises:

a pivotable element pivotably coupled to the snowboard at a forward portion of the binding plate; and means for securely positioning the pivotable element in selected pivoted positions with respect to the binding plate;

wherein said at least one flexible strap clement is secured to the pivotable element;

wherein the binding plate defines two sides; and wherein said means for securely positioning the pivotable element in selected pivoted positions comprises an adjustable locking assembly located on both sides of the binding plate, each adjustable locking assembly including interlocking portions, one of said portions being associated with said pivotable element and another of said portions being operatively coupled to said binding plate on each side thereof, for locking said pivotable element in different pivoted positions.

* * * * *